US006290632B1

(12) United States Patent
Blake et al.

(10) Patent No.: US 6,290,632 B1
(45) Date of Patent: Sep. 18, 2001

(54) ULTRAFINE MATTE FINISH ROLL FOR TREATMENT FOR SHEET PRODUCTS AND METHOD OF PRODUCTION

(75) Inventors: Sallie L. Blake, Long Grove, IA (US); Jean Ann Skiles, Gibsonia, PA (US); J. David Mackin, De Witt, IA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/208,944

(22) Filed: Dec. 10, 1998

(51) Int. Cl.[7] ..... B25F 5/02

(52) U.S. Cl. ..... 492/54

(58) Field of Search ..... 492/54, 37, 58; 101/476, 477, 480; 428/687, 612, 457; 72/199; 427/327, 126.1, 249

(56) References Cited

U.S. PATENT DOCUMENTS 4,847,112 * 7/1989 Halleux ..... 427/53.1
4,850,089 * 7/1989 Monfort et al. ..... 29/121.8
5,025,547 * 6/1991 Sheu et al. ..... 29/527.4
5,215,845 * 6/1993 Yusa et al. ..... 430/106.6
5,307,593 * 5/1994 Lucker et al. ..... 51/281
5,340,636 * 8/1994 Kamada ..... 428/141
5,506,017 * 4/1996 Ranjan et al. ..... 428/65.7
5,550,002 * 8/1996 Kojima et al. ..... 430/258
5,552,235 * 9/1996 Bastawros et al. ..... 428/687
5,807,659 * 9/1998 Nishimiya et al. ..... 430/302
5,910,471 * 6/1999 Christianson et al. ..... 51/295
6,081,287 * 6/2000 Noshita et al. ..... 347/203

* cited by examiner

*Primary Examiner*—David P. Bryant
*Assistant Examiner*—Marc W. Butler
(74) *Attorney, Agent, or Firm*—Julie W. Meder; Charles Q. Buckwalter

(57) ABSTRACT

The present invention is directed to the texturing of rolls for rolling sheet and plate metals, such as aluminum and aluminum alloys, other metals and their alloys, laminates and composites, where the rolled sheet or plate is textured by the textured roll.

34 Claims, 4 Drawing Sheets

ULTRAFINE MATTE FINISH ROLL FOR TREATMENT FOR SHEET PRODUCTS AND METHOD OF PRODUCTION

FIELD OF THE INVENTION

The present invention is directed to a single or plurality of engineered textured rolls for treating aluminum, its alloys, other metals and their alloys, composites and laminates, to provide an inventive textured surface for holding, bonding, or adhering a variety of materials thereto.

BACKGROUND OF THE INVENTION

It is axiomatic that in the field of rolling metals that as rolls the roll, so rolls the metal product. As simple as that sounds, the art is filled with methods and apparatus that are designed to provide some property or characteristic that points the finished product towards an improved product to attract the ultimate consumer.

The present invention is directed to improving the surface of metals and their alloys, particularly aluminum and aluminum alloys, so that a variety of materials may be bonded, attached, adhered, mated, held, either permanently or temporarily, to the surface of the finished product which may be a foil sheet, a plate, a composite or laminate. Such useful products as used in lithography, for flexographic plates, computer-to-plate lithography, weldable products for the construction or building of things, rigid containers to hold other things, lighting materials to shed light on these things, vehicles, such as cars, boats, and airplanes, all can benefit from the surface treatments that are a part of this invention.

That others have been working in this field and pointed in various ways is illustrated by the following reference materials. U.S. Pat. No. 5,025,547 is directed to a method of providing textures on material by rolling. In this instance, the patent tells how to retain lubricant on the surface and reduce wear debris generated during rolling operations. U.S. Pat. No. 4,847,112 is directed to surface treatment of a rolling mill roll which uses a laser to treat the roll surface. U.S. Pat. No. 4,850,089 is similarly directed to treating rolling mill rolls only in this instance metal coatings are used. Finally, U.S. Pat. No. 5,552,235 is directed to embossed cold rolled steel for use in corrosion resistance, paintability, and appearance. While the above is not an exhaustive list of the various fields in this art, it is representative of a portion thereof.

Attention is drawn to U.S. Ser. No. 08/607,541 filed Feb. 27, 1996 entitled "Texture Rolled Lithosheet" that is presently pending before the U.S. Patent Office. While this application is pending, the now abandoned PCT related application, WO 97/31783, was published on Sep. 4, 1997, which is herein incorporated by reference.

The aluminum alloys of particular interest are those that have been registered with the Aluminum Association. As those skilled in this art appreciate, those registrations are found in the 1000, 2000, 3000, 5000, 6000, 7000, and 8000 series aluminum alloys. By reference to the series hereinabove, includes the individual registrations throughout each series represented by such alloys as 1050, 2524, 3103, 5183, 6013, 7055, 8079 etc. The surfaces of these alloys benefit from treatment under the inventive rolls hereof and can be designed for an intended purpose in the beneficial use of aluminum alloys.

That this field is important to various human endeavors is not questioned since there is a resplendent historical significance attached to the Age of Metallurgy, such as the Bronze Age, thus helping to pull cave persons into the light, possibly aiding in walking upright, and certainly central in the conquering of worlds. Importantly, for today's world, improvements in the surfaces of metals and their alloys provides improved products and services to a variety of industries, such as printing, lighting, building and construction, packaging, and the vehicular trades.

SUMMARY OF THE INVENTION

The present invention is directed to a single or plurality of surfaces of rolls treated with a texturing means to provide an extended surface area to said roll surfaces to provide a single or plurality of treated roll surfaces wherein said treated roll surfaces are placed in a single or plurality of roll sets, said roll sets communicate with a work piece such as metal, metal alloys, composites, and/or laminates whereby the texture of the treated roll imparts a substantially uniform topography wherein said topography is substantially uniform in the rolling and cross-rolling directions of the work piece, which may be a treated sheet or plate product, and comprising an Ra value of about 5 to 45 microinches wherein the Ra ratio of rolling to cross-rolling is about 0.8 to 1.2. The texturing means can be effected by electron discharge texturing, laser texturing, electron beam, shot peening, mechanical texturing, and chemical etching and some combination thereof, preferably arc texturing, electron discharge texturing and shot peening and most preferably electron discharge texturing.

The invention hereof conveniently lends itself to a pre and post treatment of the roll and/or the work piece, either prior to texturing or thereafter. For either the pre or post treatment, a roll or work piece is cleaned with a suitable cleaning means such as discussed below, incorporated hereof, and then roughened. Roughening may be achieved by mechanical roughening of the work piece and/or roll with a system of rotating brushes and an abrasive slurry applied at a force substantially normal to the substrate surface. In another embodiment, chemical roughening of the work piece and/or roll with a solution which comprises a single or plurality of inorganic acids, or alkaline compounds, which ever is appropriate, and/or organic acids, esters, or other active end groups, including but not limited to imides, amides, and inorganic electrolytes, moieties, mixed complexes, and some combination thereof. In a preferred method of treating the work piece or roll surface, electrochemical roughening of the substrate is effected with a solution comprised of inorganic acids, organic acids, esters, and/or other active end groups including but not limited to imides, amides, and inorganic electrolytes, moieties, mixed complexes and some combination thereof. It is found especially advantageous in electrochemical roughening to apply a single or plurality of alternating currents or by applying a direct current thereby causing electrochemical roughening of the surface. Alternating current is preferred.

In the event that a roll has been plated additional means is available to treat the plated surface to effect an alternative cornucopia of textures. These include but are not limited to electron discharge, arc discharge, shot peen texturing, and some combination thereof. Other texturing means either aforementioned or hereafter are included here by reference. In terms of plating the roll that is discussed elsewhere hereof as to the means and the plating metals, and is incorporated herein as valuable plating means and plating material. It is contemplated that the work piece may also be affected by these means and metals as well, as discussed below. As another embodiment, should the work piece itself be textured by some means after texturing by a textured roll, this textured surface may be additionally textured by the means disclosed hereof.

Typically, the roll is comprised of an iron derived alloy, usually steel and any one of the alloys thereof. Extending the surface of the treated roll means to increase the surface area of the roll to about 0.05 to 50%, preferably 1 to about 50%, most preferably 10 to about 50% when compared to an untreated roll. Up to and about 50% includes all of the percentages below 50%, such as 45%, 40%, 35%, 30%, 29%, 28%, 22%, 20%, 19%, 10%, 5%, 2%, 1.5%, etc. down to 0.05%. The increase in the surface area is substantially orthogonal to the length of the roll. For the most part an untreated roll has elongated troughs. By texturing the roll submicron craters and/or indentations are created thereon the negative image thereof can subsequently be transferred at least in-part to the surface of the foil sheet or plate thereby increasing the overall and the working surface area. Treated rolls may also mean, optionally, that the roll is first plated and then textured. Roll plating is achieved by electrochemically plating, chemically, thermomechanically, mechanically plating, plating by sputter deposit, vapor deposition and some combination thereof The plating may be in a single or plurality of layers. The preferred plating is electrochemically in one or more layers. Plating metals comprise nickel, chrome, cobalt, and tungsten or some combination thereof It is preferred to use chrome. The plating layers range from 0.01 to about 20,000 microns, preferably about 0.01 to 100 microns (0.39 to 3,937 microinches), more preferably 0.1 to 50 microns (3.9 to 1,968 microinches), and most preferably 1 to 20 microns (39 to 787 microinches).

After the roll has been treated the roll is placed in a roll set. Typically two rolls are placed in a roll set opposing one another. The roll set may have one treated roll and an opposing untreated roll or optionally may have two treated rolls opposed to each other. A roll set may be a stand alone operation or may have a plurality of roll sets placed in series to continuously roll foil, sheet or plate metal and metal alloys, preferably aluminum alloy.

The treated rolls communicate with the metal and metal alloys through reduction and/or through simply texturing and surface modification. Reduction is an optional but highly useful operation. Reductions range from 0.1 up to about 10%, preferably from about 1 to 4%.

Metal and metal alloys comprise aluminum and its alloys, composite and laminate materials, steel and its alloys, the coinage metals, and other useful metals out of the periodic chart and combinations thereof, especially those in the transition series. For the purposes of the present invention aluminum and aluminum alloys are the preferred metals. Most preferably the 1000, 3000, 5000 and 6000 series aluminum alloy. Sizes of foil sheet and plate can be as large as a 6 by 12 foot panel (1.2 by 2.5 m) or as small as 4 by 8 inches (10.2 by 20.3 cm). Usually, especially for lithographic purposes, the plate is 16 by 24 inches (40.6 by 61 cm)

Without texturing, rolled metal alloy sheet and plate have an identifiable bias. The rolling activity creates what is called roll grind. See for example FIG. 1 which is an optical photograph of as-rolled 3103-H25 sheet. Note should be made of the striations which is the roll grind. As that name evokes, roll grind, is the creation of striations that run lengthwise to the rolled alloy. These striations may interfere with certain downstream activities such as lithography. In lithography, for example, the sheet surface is coated with a light sensitive coating. The run life and printed image definition is controlled by the bond strength of the aluminum to the coating and the directionality of the resultant product. The presence of roll grind in this product results in an end product with low run life and poor definition due to poor bond strength and directionality. To combat these effects the typical litho plate manufacturer will chemically or mechanically grain the surface of the aluminum to create more extended surface area to enhance the coating bond strength and improve the directionality of their product. The textured roll of the present invention has advantageously effected this result. It has been found that a single pass through the roll is capable of ridding the plate of a substantial portion of roll grind. This pass also increases the surface area which improves the coating load strength and print definition. However, from time to time it is found that a single pass may effect a surface devoid of bias, the first pass itself may create nonuniformity evidenced by optical striping, rolling blemishes and discrete areas that lack texture. Therefore, in certain circumstances it is preferred to make at least two passes through the roll set to obtain the desired texture. More than two passes can be made, but increase the costs of each plate so treated for little return.

Foil sheet and plate texture may be evaluated using a Perthen® instrument model M4P. From the measurement taken by this instrument depth of texture values can be determined. For the purposes of the invention, average depth to peak height distances of textured values or "Ra" range from about 5 to 45 microinches (12.7 to 114.3 microcm), preferably 10 to 35 microinches (25.4 to 88.9 microcm), and most preferably 15 to 30 microinches (38.1 to 76.2 microcm). Included in the ranges herein described are all values of Ra therebetween, including but not limited to 5.0, 5.1, 5.2, etc. up to and including 44.8, 44.9, 44.95 etc.

The Ra value is an important parameter for the determination of the kind of texture that has been imposed on the roll. For example, in the production of lithographic plate, the desired average Ra value may be 10 microinches. In order to achieve that average value, the roll itself must have the appropriate depth of impingement vis a vis the plate elsewise that average will not be met. To adjust the depth of impingement the amperage applied to the roll during texturing is varied. The range of amperage applied is about 0.1 to 5 amps, preferably 1 to 4 amps, and most preferably 1 to 3 amps. The range includes without intending to exclude, the amperage values of 0.12, 0.15, 0.19, etc. on up to an including 4.85, 4.9, etc. throughout the amperage range.

As those in this art appreciate, in the production of wrought products, work debris is created that may disadvantage a final product. Accordingly, from time to time the work apparatus and work piece may have to be wiped with certain agents to insure that the surfaces of both the roll and work piece are substantially contaminant free. The cleaning agents can range from a soapy water solution to any number of organic solvents. It is preferred to use simple alcohols such as methyl or ethyl alcohol combined with water since both organic and inorganic contaminants may be present. The solvent is usually applied by wiping with a cloth or cloth like material.

The performance of the finished product is dependent upon use. For example, in lithography a goal is to provide a lithographic plate that may cycle from a minimum of 40,000, 50,000, 60,000 and exceed 100,000 cycles.

DETAILED DESCRIPTION

A steel roll was textured in the following manner. The roll was textured by an outside vendor, NEO Industries located in Portage, Indiana, at settings predetermined by the inventors hereof The particular settings in this instance were 2 amps and 3.7 gap volts. The entire working surface of the roll was so treated. The treated roll was then placed in a roll set with an opposing untreated roll. The treated roll was placed in the top roll position. A coil of sheet was treated by the roll set by one pass through the roll set. The coil was 1050 aluminum alloy with an Ra of 4 to 6 microinch topography as an untreated coil. The coil was reduced by the roll by 2%. After the roll, the cross grain Ra was 11.3 microinches and 12.2 microinches with the grain. The cross grain peak count was 624 counts per inch with a 5 microinch bandwidth and a with-the-grain peak count of 551 counts per inch. These peak count and Ra measurements were determined with a Phase Shift® interferometer.

A coil of 3103 aluminum alloy was also similarly treated as above. The untreated surface topography Ra was 4–6 microinches. The coil was reduced by 2%. After the roll treatment, the cross grain texture was 11.7 microinches and 11.8 with the grain. The cross peak count was 681 counts per inch and a grain peak count of 559 counts per inch.

It is worthy to note that the cross grain and with-the-grain peak count measurements for both of these examples are close to identical. The Ra with and across the grain are also typically close to identical. Typically, a cross the grain versus with-the-grain Ra ratio of 0.8 to 1.2 is desired, with a ratio of 0.9 to 1.1 more preferred and a ratio of 0.95 to 1.05 most preferred. With this kind of Ra ratio the finish of the sheet appears as a matte finish.

The Table shows the initial conditions of the foil sheet of two separate alloys, 1100 and 1050 series aluminum alloys. It is noteworthy that while the roughness does not appreciably change between roll passes, the metal finish peak count makes a dramatic increase. This increase provides an increase of almost 50% in the surface area of the foil sheet.

Figure 1:
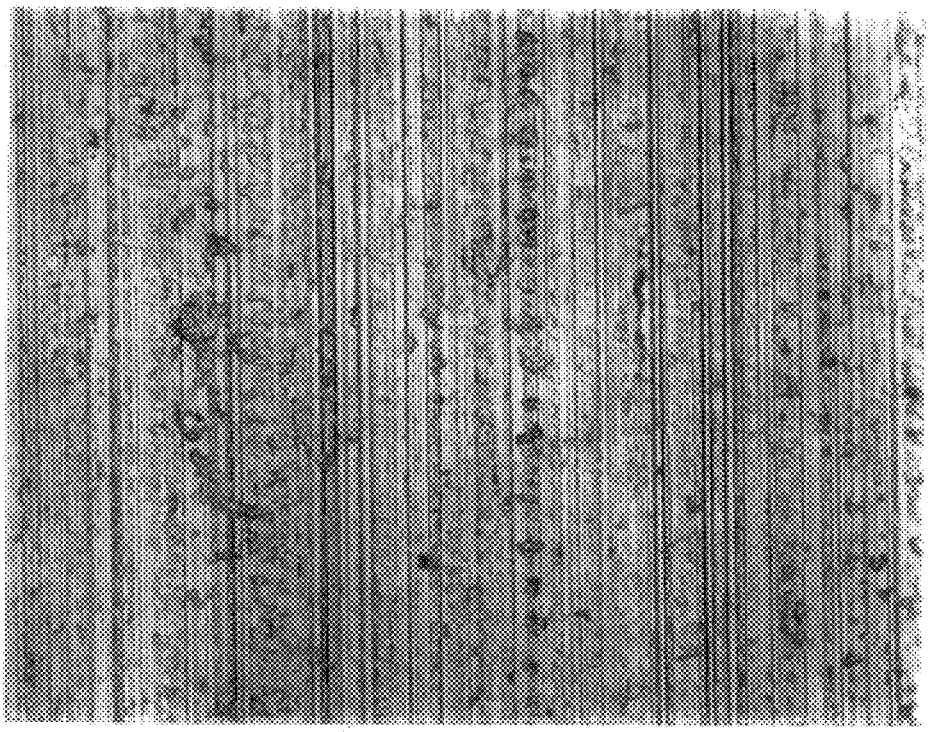
FIG. 1 Optical photograph of as-rolled sheet magnified 200X.
Figure 2:
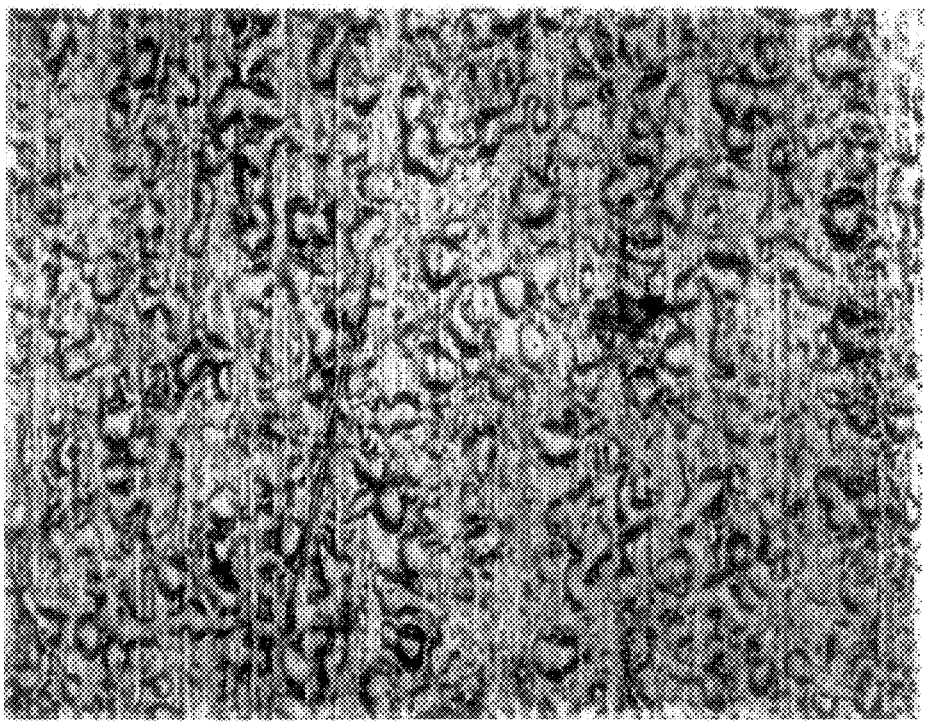
FIG. 2 Optical photograph of sheet roll textured with steel roll, 1 pass magnified 200X.
Figure 3:
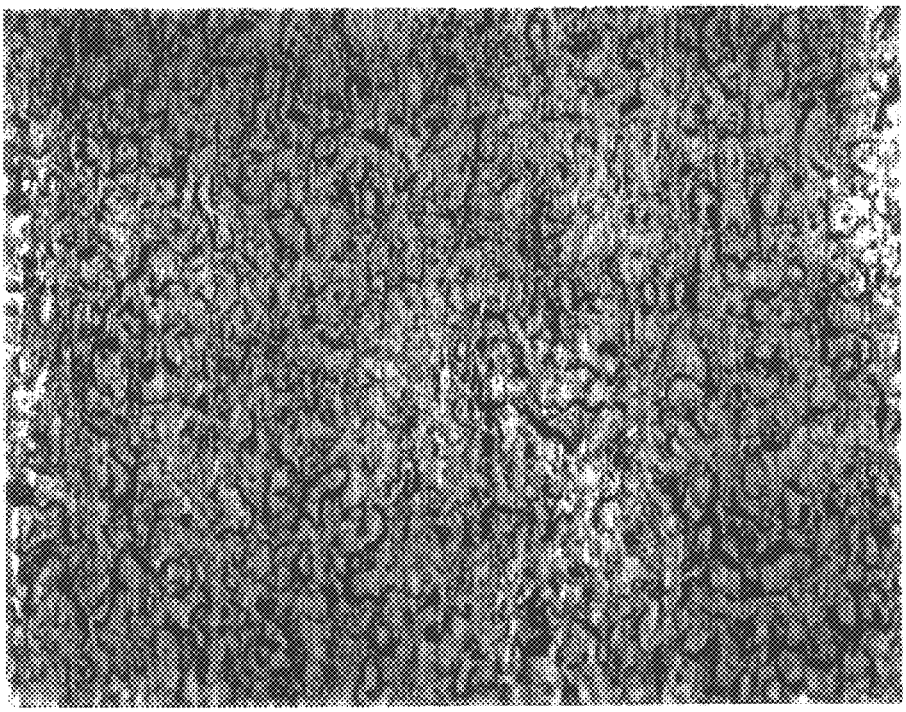
FIG. 3 Optical photograph of sheet roll textured with steel roll, 2 passes magnified 200X.
Figure 4:
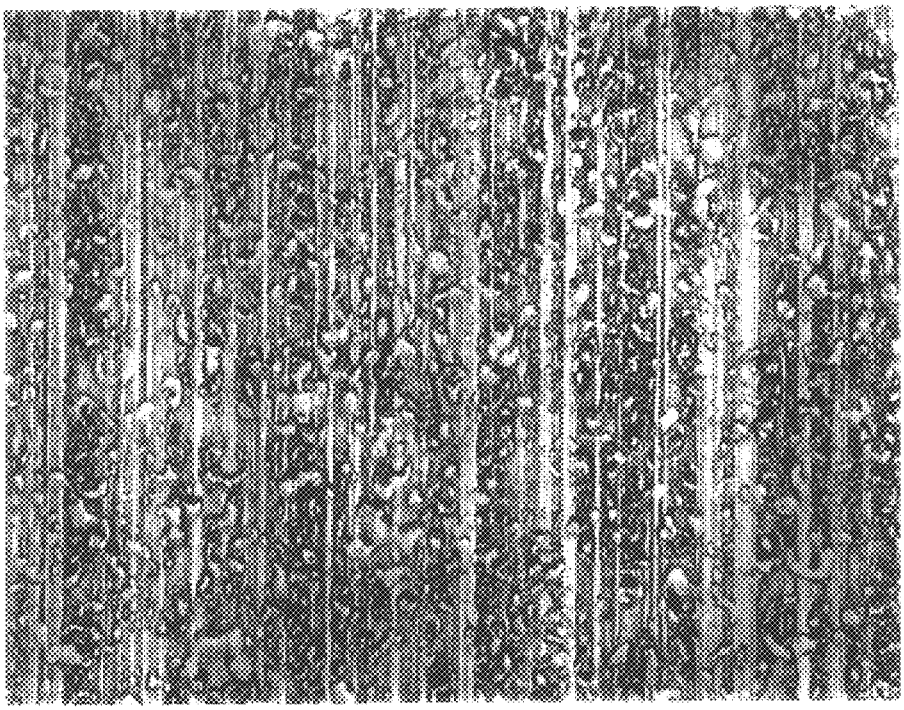
FIG. 4 Optical photograph of sheet roll textured with chrome-plated steel roll, 1 pass, magnified 200X.
Figure 5:
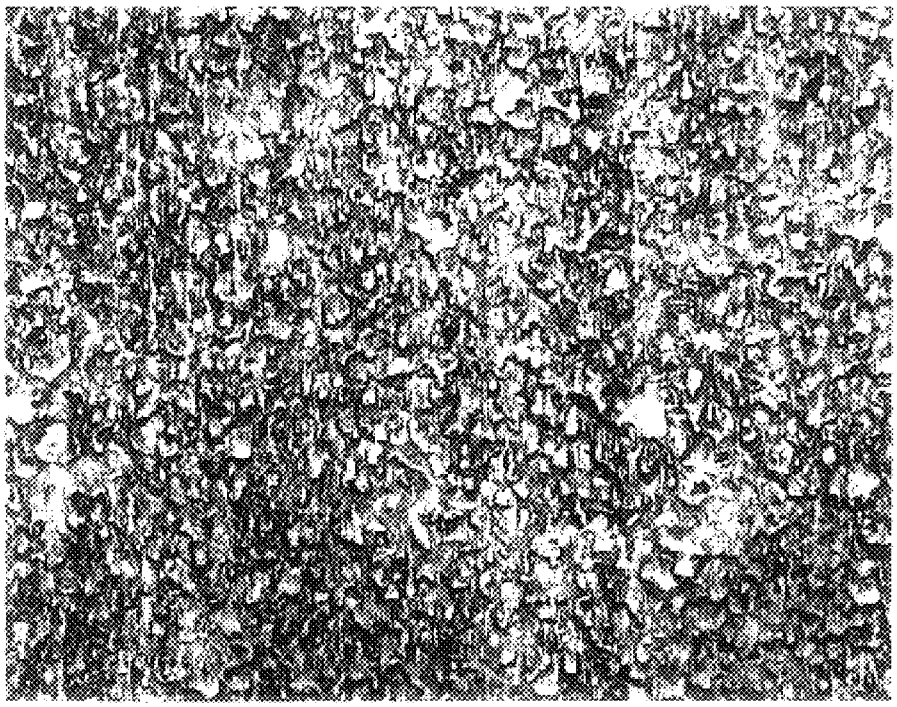
FIG. 5 Optical photograph of sheet roll textured with chrome-plated steel roll, 2 passes, magnified 2000X.

FIGS. 1 through 5 are optical photographs at a magnification of 200 of the surfaces of an untextured foil sheet, and four textured foil sheets with FIG. 2 showing the effect of one pass, FIG. 3 showing the effect of 2 passes, FIG. 4 showing the effect of one pass, and FIG. 5 showing the effect of 2 passes. FIGS. 2 and 3 are alloy 3103, with no plating but a textured roll and FIGS. 4 and 5 are alloy 1100, with a roll plated with chrome and then textured. It is clear that without the textured finish with at least one pass, the striations of FIG. 1 dominate the surface topography. In FIGS. 2 and 4, one pass is necessary but in these examples not sufficient to rid the surface of all of the striations. However, FIGS. 3 and 5, show the very positive effect of a second pass over a single pass which results in a surface topography substantially devoid of the disfiguring striations.

Figure 6:
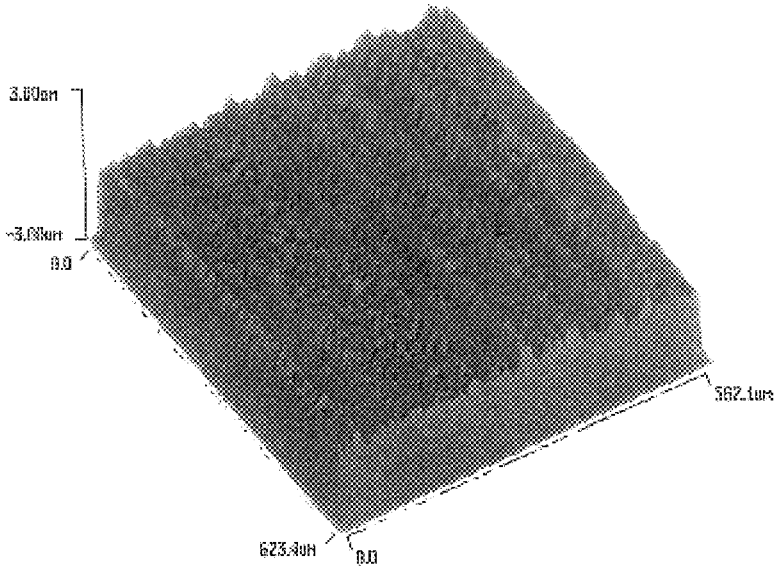
FIG. 6 Interferometer image of the surface of an untextured sheet roll.
Figure 7:
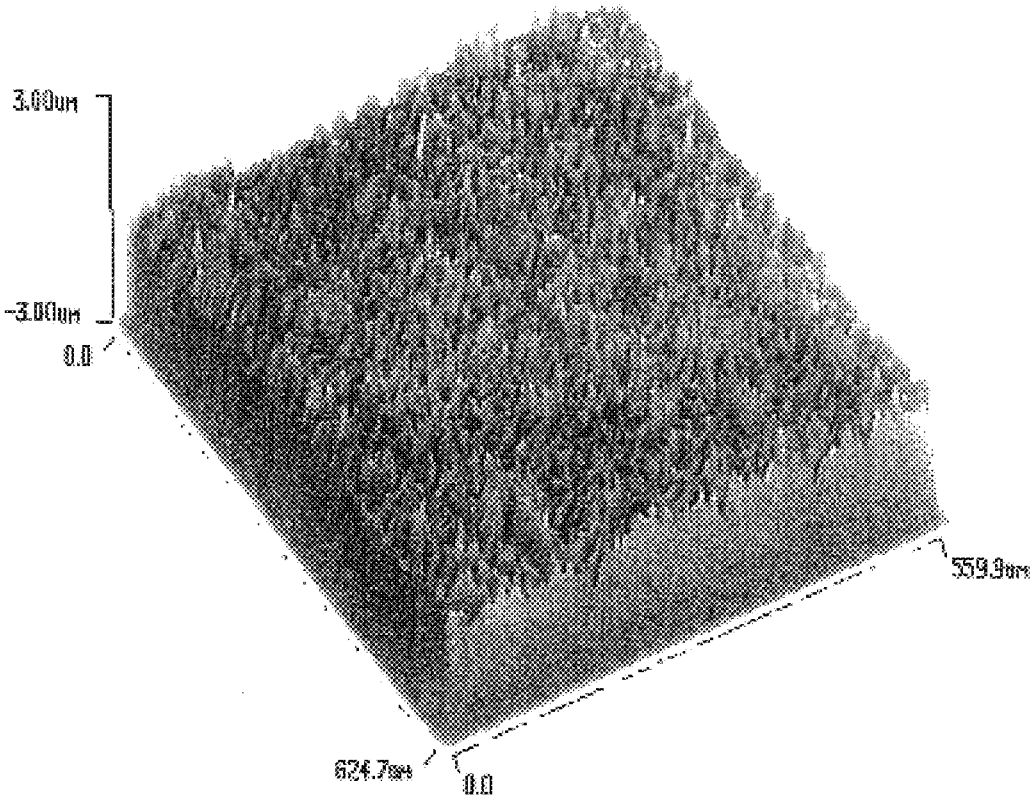
FIG. 7 Interferometer image of the surface of a textured sheet roll.

FIGS. 6 and 7 show data imaging from the interferometer. FIG. 6 shows the striations while FIG. 7 shows a much improved uniformity and enhanced surface area.

What is claimed is:

1. A single or plurality of surfaces of rolls treated with a texturing means to provide an extended surface area to said surfaces of rolls, to provide a single or plurality of treated roll surfaces wherein said treated roll surfaces, which optionally are plated, are placed in a single or plurality of roll sets, said roll sets being configured to roll a work piece whereby a texture of each said treated roll surface imparts in a work piece, rolled thereby a substantially uniform topography in the rolling and cross-rolling directions of the work piece such that the work piece has an Ra value of about 5 to 45 microinches and a ratio of a with-the-grain Ra value to a cross grain Ra value of about 0.8 to 1.2.

2. The surfaces of rolls of claim 1 wherein said texturing means is selected from the group consisting of electron discharge texturing, laser texturing, electron beam, shot peening, mechanical texturing, chemical etching and combination thereof.

3. The surfaces of rolls of claim 1 wherein said extended surface area is extended from about 0.05 to 50% when compared to an untreated roll.

TABLE

| Alloy | 1 pass 1100 | 2 passes 1100 | 1 pass 1050 | 2 passes 1050 |
|---|---|---|---|---|
| starting metal roughness | 7.9 microinches | 8.6 microinches | 7.6 microinches | 6.0 microinches |
| starting metal thickness | 0.008 in | 0.0078 in | 0.0006 in | 0.0059 in |
| starting top roll roughness | Ra = 26 | Ra = 26 | Ra = 23 | Ra = 23 |
| starting top roll peak count | 619 | 619 | 720 | 720 |
| starting bottom roll roughness | 3.5 microinches | 3.5 microinches | 3.5 microinches | 3.5 microinches |
| finish metal roughness | 8.6 microinches | 8.6 microinches | 6.0 microinches | N/A |
| metal finish peak count | 979 | 918 | 914 | N/A |
| roll chrome plate thickness | 0.0005 in | 0.0005 in | 0.0003 in | 0.0003 in |
| EDT texture amperage | 2 | 2 | 1 | 1 |

4. The surfaces of rolls of claim 1 wherein said extended surface area is extended from about 1 to 50% when compared to an untreated roll.

5. The surfaces of rolls of claim 1 wherein said extended surfaces area is extended from about 10 to 50% when compared to an untreated roll.

6. The surfaces of rolls in claim 1 wherein said surfaces are plated.

7. The surfaces of rolls of claim 1 wherein said surfaces are first plated and then textured.

8. The surfaces of rolls of claim 1 wherein said surfaces are plated by a means selected from the group consisting of electrochemical, chemical, thermomechanical, mechanical, sputter deposit, vapor deposit and combination thereof.

9. The surface of rolls of claim 1 wherein said surfaces are plated in a single or plurality of layers from about 0.01 to 20,000 microns.

10. The surface of rolls of claim 1 wherein said surfaces are plated in a single or plurality of layers from about 0.01 to 100 microns.

11. The surface of rolls of claim 1 wherein said surfaces are plated in a single or plurality of layers from about 0.1 to 50 microns.

12. The surface of rolls of claim 1 wherein said surfaces are plated in a single or plurality of layers from about 1 to 20 microns.

13. The surface of rolls of claim 1 wherein said surfaces are plated with a metal selected from the group consisting of nickel, chrome, cobalt and tungsten.

14. The surface of rolls of claim 1 wherein said surface are plated with chrome.

15. The surface of rolls of claim 1 wherein said rolls comprise a pre treatment selected from the group consisting of mechanical, chemical, and electrochemical roughening.

16. The surface of rolls of claim 1 wherein said rolls comprise a post treatment selected from the group consisting of mechanical, chemical, and electrochemical roughening.

17. A work piece with a surface area wherein said work piece is rolled with textured rolls wherein said textured rolls provide an extended surface area of said work piece and imparts in said work piece a substantially uniform topography in the rolling and cross-rolling directions, said work piece having an Ra value of about 5 to 45 microinches and a ratio of a with-the-grain Ra value to a cross grain Ra value of about 0.8 to 1.2.

18. The work piece of claim 17 wherein said work piece is an aluminum alloy selected from the group comprising 1000, 3000, 5000, 6000, and 7000 series aluminum alloy.

19. The work piece of claim 17 wherein said work piece comprises Ra values from about 10 to about 30 microinches.

20. The work piece of claim 17 wherein said work piece comprises Ra values from about 15 to 30 microinches.

21. The work piece of claim 17 wherein said work piece is selected from the group comprising foil sheet, plate, laminate, or composite.

22. The work piece of claim 17 wherein said work piece consists of 1050 aluminum alloy.

23. The work piece of claim 17 wherein said work piece consists of 3103 aluminum alloy.

24. The work piece of claim 17 wherein said ratio is about 0.9 to 1.1.

25. The work piece of claim 17 wherein said ratio is about 0.95 to 1.05.

26. The work piece of claim 17 wherein said work piece comprises an Ra range from about 10 to 35 microinches.

27. The work piece of claim 17 wherein said work piece comprises an Ra range from about 15 to 30 microinches.

28. The work piece of claim 17 wherein said work piece is lithographic plate.

29. The work piece of claim 17 wherein said extended surface area is extended from about 0.05 to 50%.

30. The work piece of claim 17 wherein said extended surface area is extended from about 1 to 50%.

31. The work piece of claim 17 wherein said extended surface area is extended from about 15 to 50%.

32. The work piece of claim 17 wherein said work piece is lithographic.

33. The work piece of claim 17 wherein said work piece topography comprises a pre treatment selected from the group consisting of mechanical, chemical, and electrochemical roughening.

34. The work piece of claim 17 wherein said uniform topography comprises a post treatment selected from the group consisting of mechanical, chemical, and electrochemical roughening.

* * * * *

UNITED STATES PATENT AND TRADEMARK OFFICE

CERTIFICATE OF CORRECTION

PATENT NO. : 6,290,632 B1
DATED : September 18, 2001
INVENTOR(S) : Sallie L. Blake et al.

It is certified that error appears in the above-identified patent and that said Letters Patent is hereby corrected as shown below:

Column 8,
Line 4, delete “comprising” and insert therefor -- consisting of --.
Line 11, delete “comprising” and insert therefor -- consisting of --.
Line 12, delete “or” and insert therefor -- and --.
Line 34, after “lithographic” insert -- plate --.

Signed and Sealed this

Twenty-sixth Day of November, 2002

*Attest:*

*Attesting Officer*

JAMES E. ROGAN
*Director of the United States Patent and Trademark Office*